US005827142A

United States Patent [19]

Rappaport

[11] Patent Number: 5,827,142

[45] Date of Patent: Oct. 27, 1998

[54] AIR-PRESSURIZED BASEBALL BAT

[76] Inventor: Mark Rappaport, 4999 Smith Canyon Ct., San Diego, Calif. 92130

[21] Appl. No.: 383,996

[22] Filed: Feb. 6, 1995

[51] Int. Cl.[6] ..... A63B 59/06

[52] U.S. Cl. ..... 473/567

[58] Field of Search ..... 273/72 R, 72 A, 273/26 B

[56] References Cited

U.S. PATENT DOCUMENTS

| | | | |
|---|---|---|---|
| 4,917,382 | 4/1990 | Hendershott | 273/72 R |
| 5,150,897 | 9/1992 | Wortman | 273/72 R |

FOREIGN PATENT DOCUMENTS

| | | | |
|---|---|---|---|
| 37126 | 3/1977 | Japan | 273/72 R |
| 2146538 | 4/1985 | United Kingdom | 273/72 R |

*Primary Examiner*—Mark S. Graham

*Attorney, Agent, or Firm*—Michael Ebert, Esq.

[57] ABSTRACT

A light-weight, air-pressurized baseball bat useable by children to strike a ball, the bat having an enhanced striking power. The bat comprises striker and handle sections joined together by a coupler. The striker section is defined by a shell of synthetic plastic material whose shape is similar to that of a standard two-liter soda bottle. The shell is adapted to envelop a charge of compressed air and is provided with a half neck in which a valve plug is installed whose inlet projects therefrom. The handle section is provided at its upper end with a half neck that complements that of the striker section, the two-half necks being clamped together by the coupler which has a port therein to accommodate the valve inlet. By injecting compressed air into the striker section through the valve, the compressed air enveloped by the shell functions as a trampoline which when the ball impinges on the shell then acts to boost the rebound of the ball, thereby enhancing the striking power of the bat.

4 Claims, 3 Drawing Sheets

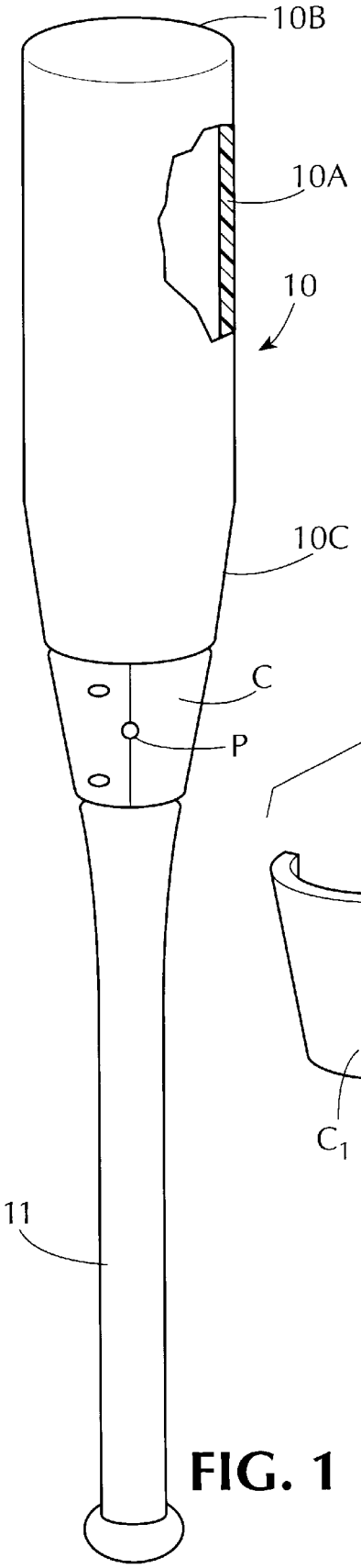
FIG. 1
FIG. 2
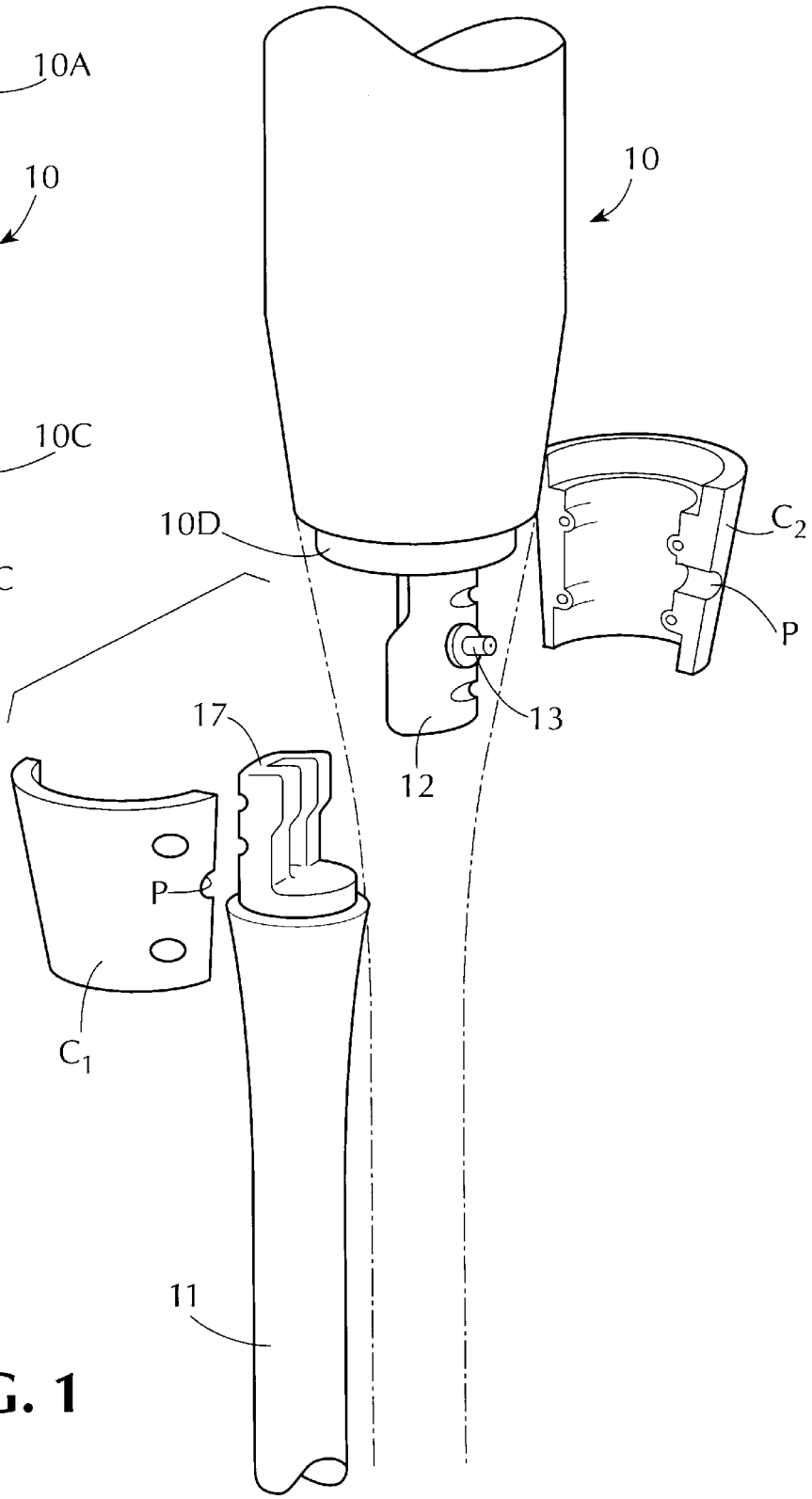

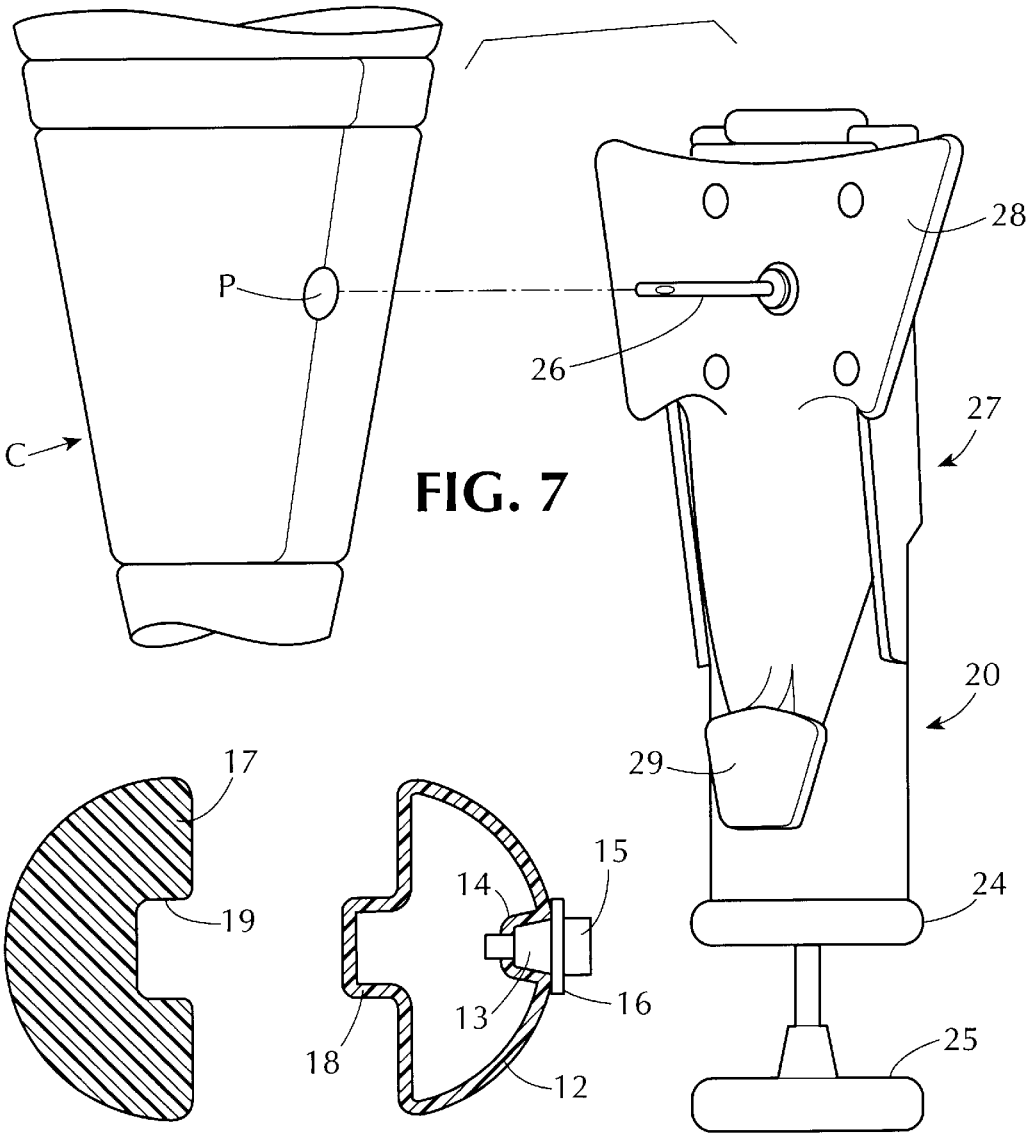
FIG. 7
FIG. 4
FIG. 3
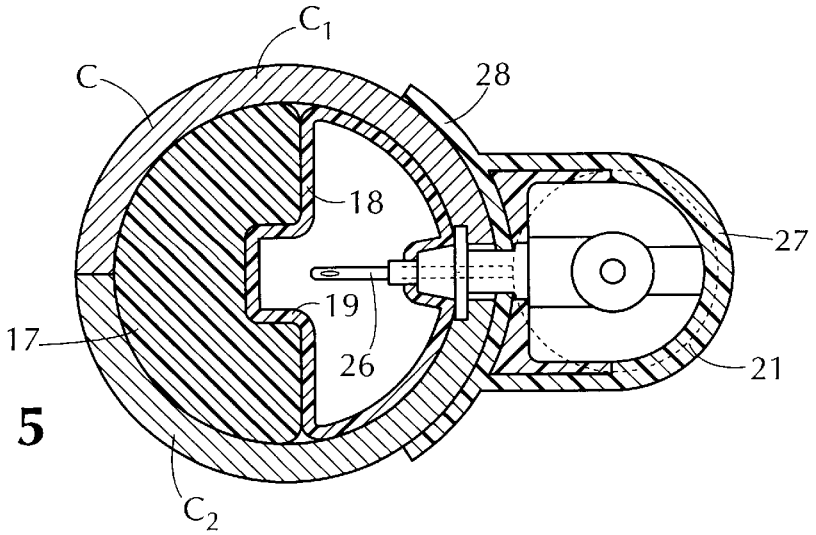
FIG. 5

AIR-PRESSURIZED BASEBALL BAT

BACKGROUND OF INVENTION

1. Field of Invention

This invention relates generally to light-weight baseball bats useable by children, and more particularly to a bat having a hollow striker section defined by a shell of flexible plastic material filled with compressed air which functions as a trampoline to enhance the striking power of the bat.

2. Status of Prior Art

Hollow baseball bats are designed to be used by children who are incapable of handling relatively heavy regulation bats. Though resembling in form a standard baseball bat, these hollow bats are blow molded or otherwise fabricated of high-strength synthetic plastic material and are therefore much lighter in weight. A regulation bat made of hard wood is not only too heavy for most young children to manipulate, but it is also in the hands of a child a dangerous club.

Whether the baseball bat is of hollow construction or a regulation bat, it includes a striker section whose upper portion has a large uniform diameter and a lower portion of progressively diminishing diameter which merges with the handle section of the bat. In a hollow bat for children, the diameter of the striker section may be greater than that of a regulation bat so that the child holding the hollow bat is more likely to connect with an oncoming ball.

Disclosed in the Souders U.S. Pat. No. 4,505,479 is a baseball bat having a hollow aluminum striker section. In order to increase the weight of the bat and give it better striking power, the interior of the aluminum striking section is filled with a foam plastic body.

The hollow baseball bat for children shown in the Spector U.S. Pat. No. 5,071,123 is molded of plastic material. As pointed out by Spector, while the light weight of this bat makes is easier for children to handle, the bat lacks striking power and the player therefore may not be able to hit a ball more than a short distance. In order therefore to lend greater heft to the bat, Spector places a weighted insert in the hollow of the bat. The Lanctot et al. U.S. Pat. No. 5,180,163 shows a hollow baseball bat filled with oil, not to enhance its striking power but to dampen shock when the bat strikes a ball .

Of greatest prior art interest is the Foreman reissue Pat. No. RE 31,881 which discloses a hollow baseball bat formed of aluminum that is filled with compressed air to improve its ball-driving characteristics. The Foreman bat is provided at one end with a rubber plug that functions as a valve, the bat being charged with compressed air by injecting a hypodermic needle into the plug, the needle being coupled to a compressed air source.

But while a hollow aluminum bat is not as heavy as a regulation bat made of hard wood, it still acts as a club, and can be used as such by a child, to inflict an injury. Moreover, an aluminum bat filled with compressed air does not have a significantly enhanced striking power.

SUMMARY OF INVENTION

In view of the foregoing, the main object of this invention is to provide a light-weight, air pressurized baseball bat useable by children to strike a ball, which bat despite its light weight has a considerably enhanced striking power.

More particularly, an object of this invention is to provide a baseball bat of the above type whose striker section is defined by a thin plastic shell enveloping a charge of compressed air which functions as a trampoline whereby when a ball impinges thereon it then boosts the rebound of the ball. Hence even when the ball is lightly struck by the bat, it is driven a relatively long distance.

A significant feature of a bat in accordance with the invention is that it is safe in the hands of children, for the plastic shell of the striker section is incapable of inflicting injury even when filled with compressed air.

Also an object of the invention is to provide a hollow baseball bat whose plastic shell which forms the striker section has a shape similar to that of a conventional two liter plastic soda bottle and therefore may be manufactured at relatively low cost in a similar manner.

Still another object of the invention is to provide a hollow baseball bat whose three major components, a striker section, a handle section and a coupler joining these sections are easily assembled, whereby the bat may be inexpensively mass produced.

Briefly stated, these objects are attained by a light-weight, air-pressurized baseball bat useable by children to strike a ball, the bat having an enhanced striking power. The bat comprises striker and handle sections joined together by a coupler. The striker section is defined by a shell of synthetic plastic material whose shape is similar to that of a standard two-liter soda bottle. The shell is adapted to envelop a charge of compressed air and is provided with a generally semi-cylindrical half neck in which a valve plug is installed whose inlet projects from the curved side of the half neck.

The handle section is provided at its upper end with a half neck that complements the striker section half neck, the two-half necks being clamped together by the coupler which has a port therein to accommodate the valve inlet. By injecting compressed air into the striker section through the valve, the compressed air enveloped by the shell functions as a trampoline which when the ball impinges on the shell then acts to boost the rebound of the ball, thereby enhancing the striking power of the bat to a considerable degree despite the light weight of the bat.

BRIEF DESCRIPTION OF DRAWINGS

For a better understanding of the invention reference is made to the following description to be read in conjunction with the accompanying drawing wherein.

FIG. 1 is a perspective view of a hollow baseball bat in accordance with the invention;

FIG. 2 shows the components of the bat in a disassembled state;

FIG. 3 is a sectional view of the half neck of the striker section of the bat;

FIG. 4 is a sectional view of the half neck of the handle section;

FIG. 5 is a section taken through the intercoupled half-necks;

FIG. 7 is a bottom view of the pump.

DETAILED DESCRIPTION OF INVENTION

The Bat

Figure 9:
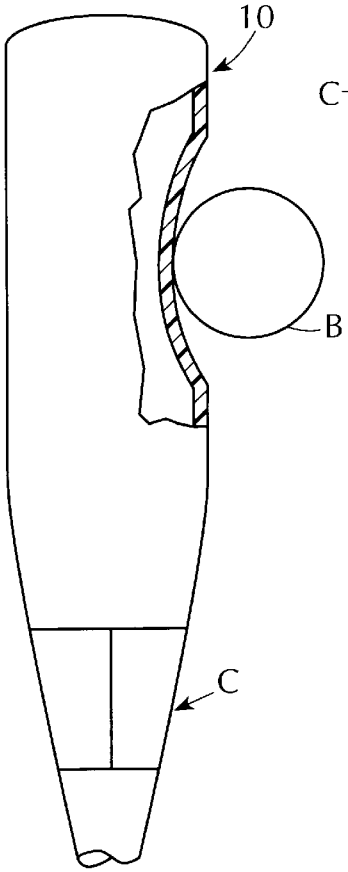
FIG. 9 illustrates a ball striking the striker section of the bat.
Figure 8:
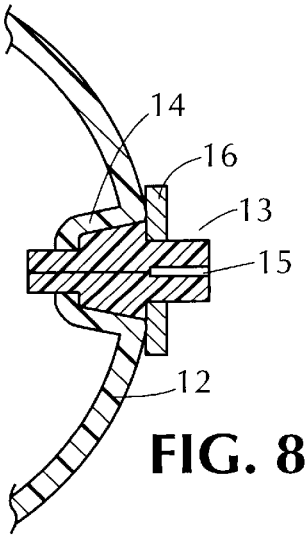
FIG. 8 separately shows how the valve plug is installed in the half neck of the striker section.

A baseball bat for children in accordance with the invention, as shown in FIGS. 1 and 2, is composed of a striker section 10, a handle section 11 and a coupler C joining the sections together so that a child grasping the handle section may strike an oncoming ball with the striker section. In practice, the ball used in play is preferably a plastic or foam ball rather than a heavier regulation baseball.

Striker section 10 is formed of thin shell of synthetic plastic material of high strength such as polycarbonate or PET that is impermeable to air. Shell 10 has a shape and size similar to that of a standard two liter plastic soda bottle and may be manufactured in a similar manner. The upper cylindrical portion 10A of the shell has a uniform diameter somewhat greater than the corresponding portion in a regulation bat so that a child handling the bat is more likely to connect with an oncoming ball. Upper portion 10A is enclosed by a dome-shaped top 10B.

The lower portion 10C of the striker section is of progressively diminishing diameter and terminates in a cylindrical collar 10D from which a hollow half neck 12 projects. Half neck 12 which has a generally semi-cylindrical form has installed in its curved wall a valve plug 13 of rubber or other elastomeric material. The plug is snugly seated, as shown in FIG. 3, in a circular well 14 formed in the curved wall of the half neck, the plug sealing the neck. Plug 13 is provided with an inlet 15 adapted to receive a hypodermic needle to inject compressed air into the striker section. When the needle is withdrawn from the plug it seals itself. A washer 16 is fitted over inlet 15 to hold the valve plug in place, the washer being pressed by coupler 12 against the valve plug.

Handle 11 which is blow-molded or otherwise fabricated of a high strength synthetic plastic material such as polypropylene or polyethylene. Extending from the upper end of the handle is a half neck 17 that complements the half neck 12 extending from the lower end of the striker section 10. As best seen in FIG. 3, half neck 12 is provided on its flat side with a projecting ridge 18. This ridge intermeshes with a complementary groove 19 indented in the flat side of the half neck 17 of the handle section, as shown in FIG. 4. When the complementary half necks 12 and 17 are clamped together by coupler C as shown in FIG. 5 the resultant full neck joins striker section 10 to handle section 11.

Coupler C which has a flower pot shape is formed of complementary arcuate pieces fabricated of cast aluminum or synthetic plastic material, the pieces $C_1$ and $C_2$ being fastened together by screws to clamp about collar 10D of the striker section and the full neck formed by complementary half necks 12 and 17.

Coupler C is provided with a port P which accommodates inlet 15 of the valve plug 13. Hence by injecting a hypodermic needle into this inlet to project into half neck 12 of the striker section, the striker section is then filled with compressed air derived from an air pump or other compressed air source coupled to the needle. In practice, the internal air pressure within the striker section is raised well above atmospheric pressure in a range of about 20 to 30 psi.

In the absence of compressed air, the thin plastic shell of the striker section is easily deflected and is not sufficiently stiff to serve as a bat for a ball. But when the internal air pressure within the shell is well above atmospheric pressure, this acts to sufficiently rigidify the shell so as to impart batting characteristics thereto. However, the compressed air does more than just stiffen the shell, for the charge of compressed air enveloped by the shell acts as a pneumatic spring causing the striker section to acquire the characteristics of a trampoline.

A conventional trampoline is constituted by a taut sheet of canvas attached with springs to a metal frame, so that one who jumps on the taut sheet compresses the underlying springs which then expand to their original state to impart an upward rebound to the jumper. In the striker section, when a ball B as shown in FIG. 9 impinges on the shell enveloping the pneumatic spring of striker section 10, the resultant is trampoline action causes the ball to rebound and to be driven a long distance.

Hence even when the striker section strikes a ball lightly, the ball is then driven a greater distance than it would have been had a known type of light-weight hollow baseball bat been used. Thus when a child swings an air-pressured bat in accordance with the invention to hit an oncoming ball hard, the ball will be then driven a relatively great distance.

In effect, an air-pressurized bat in accordance with the invention transforms an ordinary child into a great batter.

The Air Pump

Figure 6:
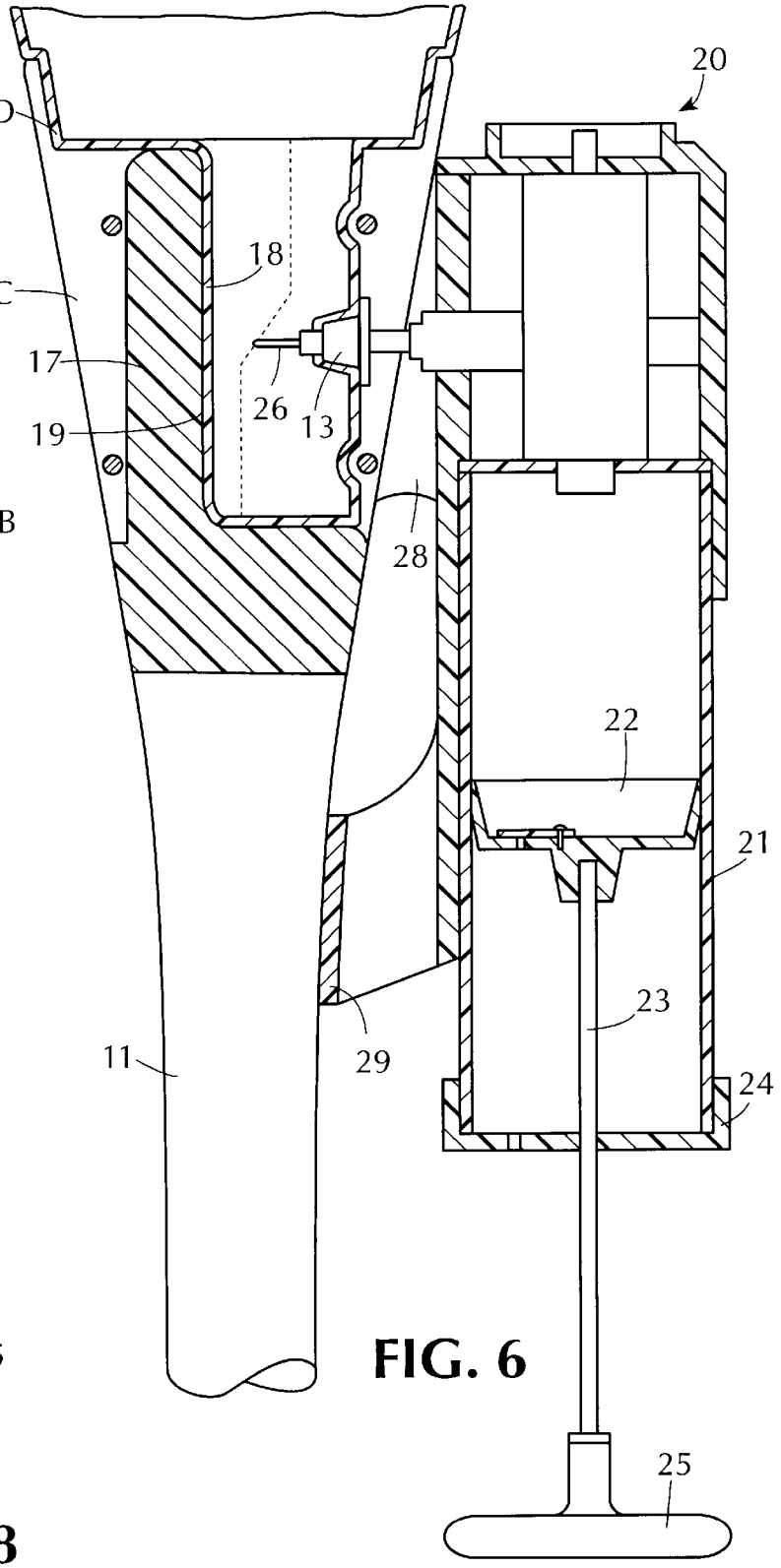
FIG. 6 illustrates a hand-operated air pump associated with the bat to inject compressed air into the striker section.

FIGS. 6 and 7 show an air pump 20 in accordance with the invention which is expressly adapted to cooperate with an air-pressurized baseball bat of the type shown in FIGS. 1 to 4. Air pump 20 includes a transparent plastic cylinder 21 having slidable therein a piston 22 whose piston rod 23 extends out of the cylinder through a rear cap 24 and terminates in an operating knob 25 as to shown in FIG. 5.

The front end of cylinder 21 is coupled through a one-way valve (not shown) to a hollow metal pin 26. Pin 26 projects laterally from the air cylinder and functions as a hypodermic needle which has a rounded point and therefore will not stick a user. However, the needle is adapted to penetrate the inlet 15 of the rubber valve 13 on half neck 12 of the striker section.

Cylinder 21 is telescoped within a molded plastic casing 27 whose shape is similar to that of a military plane having front and rear wings. Casing 27 is provided on its underside with a front wing in the form of a relatively large curved pad 28 from whose center projects hypodermic needle 26, and a rear wing in the form of a smaller curved pad 29.

When air pump 20 is put to use, it is placed against the bat 10 as shown in FIG. 6 to cause hypodermic needle 26 to penetrate the inlet 15 of the valve, the large pad 28 then conforming to coupling C and the small pad 29 to the upper end of the handle section 11 whereby the air pump is then seated neatly against the bat.

To operate the air pump, piston 22 is repeatedly reciprocated to force air through the one way valve at the front end of the air cylinder 21 to fill the striker section 10 of the bat with compressed air. The actual degree of internal air pressure within the striker section is not indicated. However, with continued reciprocation of the piston of the pump, as the pressure of air within the cylinder builds up, it becomes increasingly difficult to operate the pump until a point is reached, depending on the strength of the operator, where further reciprocation cannot be effected. The pump is then detached from the air-pressurized bat which is now in condition for play.

While there has been shown a preferred embodiment of an air-pressurized bat in accordance with the invention and an air pump therefor, it will be appreciated that many changes may be made therein without departing from the spirit of the invention.

I claim:

1. A light-weight, air-pressurized baseball bat useable by children to strike an oncoming ball so that it is driven a relatively great distance; said bat comprising:

A. a striker section defined by a shell of thin, flexible synthetic plastic film material to create an enclosed envelope impermeable to air having a shape and size similar to that of a striker section of a conventional baseball bat, said shell being provided with a one-way valve through which air is injected to produce in the envelope a compressed air charge well above atmospheric pressure whereby the charge of compressed air acts as a pneumatic spring and said shell acts as a taut spring-loaded trampoline sheet thereby causing a ball impinging thereon to rebound and be driven a relatively great distance;

B. a handle section; and

C. a coupler joining the handle section to the striker section to complete the bat, said valve being formed by a rubber plug which is penetrable by a hypodermic needle to inject compressed air in said envelope, said shell being provided at a lower end with a half neck in which the valve is installed.

2. A bat as set forth in claim 1, wherein said handle section is provided with a complementary half neck at an upper end, the half neck of the striker section and the half neck of the handle section being clamped together by said coupler to form a full neck.

3. A bat as set forth in claim 2, wherein said coupler is formed by a pair of arcuate pieces which are fastened together.

4. A bat as set forth in claim 3, in which the coupler is provided with a port to provide access to said valve plug.

* * * * *